US012421703B1

(12) United States Patent
Massat et al.

(10) Patent No.: US 12,421,703 B1
(45) Date of Patent: Sep. 23, 2025

(54) SINK DIVIDER

(71) Applicant: Hevs Solutions LLC, Frankfort, IL (US)

(72) Inventors: Jeremy Massat, Chicago, IL (US); Raymond Francis Morrogh, Jr., Charlotte, NC (US); Alexandra Rausch, Wilmington, NC (US); Raeshon McNeil, Charlotte, NC (US); Patrick Bailey, Charlotte, NC (US); Matthew Innes, Charlotte, NC (US)

(73) Assignee: Hevs Solutions LLC, Frankfort, IL (US)

( * ) Notice: Subject to any disclaimer, the term of this patent is extended or adjusted under 35 U.S.C. 154(b) by 271 days.

(21) Appl. No.: 18/216,214

(22) Filed: Jun. 29, 2023

Related U.S. Application Data

(60) Provisional application No. 63/356,504, filed on Jun. 29, 2022.

(51) Int. Cl.
*E03C 1/186* (2019.01)

(52) U.S. Cl.
CPC ..... *E03C 1/186* (2013.01)

(58) Field of Classification Search
CPC ..... E03C 1/186
USPC ..... 4/654, 514; 220/533, 544
See application file for complete search history.

(56) References Cited

U.S. PATENT DOCUMENTS

| | | | | |
|---|---|---|---|---|
| 1,051,741 | A | 1/1913 | Litton | |
| 1,817,330 | A | 8/1931 | Wilson, Jr. | |
| 2,109,089 | A | 2/1938 | Moyes | |
| 2,203,052 | A | 6/1940 | Hanson | |
| 2,651,784 | A | 9/1953 | Johnson et al. | |
| 2,765,476 | A | 10/1956 | Moore | |
| 4,333,188 | A | 6/1982 | Jensen et al. | |
| 5,423,095 | A | 6/1995 | Bearer | |
| 6,379,719 | B1 | 4/2002 | Haury et al. | |
| 7,721,362 | B2 | 5/2010 | Martin et al. | |
| 8,635,718 | B1 | 1/2014 | Giagni, Sr. et al. | |
| 9,314,143 | B2 * | 4/2016 | Bensussan | A47L 13/50 |
| 10,337,178 | B2 | 7/2019 | Bomatter et al. | |
| 2013/0000033 | A1 | 1/2013 | Gilleran | |

* cited by examiner

*Primary Examiner* — Lauren A Crane
(74) *Attorney, Agent, or Firm* — Invention To Patent Services; Alex Hobson

(57) ABSTRACT

A sink divider is detachably attachable across a sink to form a first and second compartment of the sink. The sink divider has an expandable bladder that is pressurized by a pressurization apparatus to press the bladder against the wall of the sink to create the two compartments. The pressurization apparatus includes a plunger that plunges fluid from a pressure receptacle into the bladder. A pressure valve may be fluidly coupled with the interior of the bladder to release fluid when the pressure in the bladder exceeds a threshold pressure. The sink divider may also have a pair of retainer arms that are spring deployed to press a retainer stop against the wall of the sink to further stabilize and support the sink divider within the sink.

21 Claims, 13 Drawing Sheets

SINK DIVIDER

CROSS REFERENCE TO RELATED APPLICATIONS

This application claims the benefit of priority to U.S. patent application No. 63/356,504, filed on Jun. 29, 2022, the entirety of which is hereby incorporated by reference herein.

BACKGROUND OF THE INVENTION

Field of the Invention

The invention relates to a sink divider system that is detachably attachable to a sink having expandable bladders that are pressurized by a pressurization apparatus to press the bladder against the wall of the sink to create a seal between a first portion of the sink and a second portion of the sink.

Background

Many people have a single sink and desire to separate the sink into compartments. For example, a sink may be divided into two sections or compartments for washing dishes, with one compartment retaining soapy water and the other compartment for rinsing the dishes. The rinsing compartment may be empty and the faucet may be used for rinsing the dishes. Sink dividers that are available do not effectively seal to enable water retention and are unstable and can slip or become dislodged from the pressure of water retained in one compartment, for example.

SUMMARY OF THE INVENTION

A sink divider system is detachably attachable to a sink having expandable bladders that are pressurized by a pressurization apparatus to press the bladder against the wall of the sink to create a seal between a first portion of the sink and a second portion of the sink. The sink divider system may include a suction cup retainer that is configured with a suction cup that detachably attached to the sink wall or base to further secure the sink divider in place. A sin divider is detachably attachable across a sink to form a first and second compartment of the sink, such as a dry-side and a water-side of the sink. The sink divider has an expandable bladder that is pressurized by a pressurization apparatus to press the bladder against the wall of the sink to create the two compartments. The pressurization apparatus includes a plunger that plunges fluid from a pressure receptacle into the bladder. A pressure valve may be fluidly coupled with the interior of the bladder to release fluid when the pressure in the bladder exceeds a threshold pressure. The sink divider may also have a pair of retainer arms that are spring deployed to press a retainer stop against the wall of the sink to further stabilize and support the sink divider within the sink.

An exemplary bladder and pressurization apparatus for the bladder enables the bladder to be pressurized and expanded to form an effective seal along the sink wall and sink base. The bladder may be an elastic material that expands when pressurized and retracts when the pressure is removed, such as rubber, or natural rubber, or a synthetic elastomer or polymeric elastomer, a polymer that is viscoelastic having weak intermolecular forces, and generally low Young's modulus and high failure strain compared with other materials. Examples of polymeric elastomers or elastic materials include, but are not limited to, urethane, silicone, polybutadiene, neoprene, butyl rubber, nitrile rubber, fluoroelastomer, ethylene-vinyl acetate and the like. The bladder may be tubular in geometry and have a cylindrical shape. The diameter of the bladder may expand some percentage when pressurized by the fluid and the pressurization apparatus. The pressurized diameter, or outer dimension, may be about 20% or more greater, 40% or more greater, 100% or more greater, and any range between and including the percentages provided than the unpressurized diameter or outer dimension of the bladder.

The bladder may form a loop that extends along the sides of the sink divider and along the bottom of the sink divider. The bladder may be coupled with a conduit that extends to the pressurization apparatus or may extend directly to the pressurization apparatus. The bladder may form a continuous loop or ring with an aperture in the bladder to receive the pressurization fluid into the interior of the bladder. The bladder may extend along a conduit formed by the support frame to the sides of the sink divider and then extend down along the side and along the base of the support frame or sink divider.

An exemplary pressurization apparatus has a pressure receptacle for receiving the pressurization fluid, such as water, therein. The plunger is configured to press the fluid within the pressure receptacle into the bladder. A one-way valve may be configured between the pressure receptacle and the bladder to ensure that the fluid flow into the bladder but not back into the pressure receptacle through the one-way valve. A pressurization apparatus may also comprise a pressure valve coupled with the bladder that is configured to release said fluid when a pressure in the bladder exceeds a threshold pressure level. The pressure valve may prevent over pressurization of the bladder which may cause the bladder to rupture, or dislodge from the support frame. Fluid may flow through the pressure valve and into an interior of the sink divider, or a compartment within the support frame between the covers.

An exemplary sink divider has a support frame that provides rigidity and retains the components of the sink divider system. The support frame may have support flanges or ribs to strengthen the support frame and prevent bending or flexing of the sink divider in use. The support frame may form a conduit that extends from the pressurization apparatus to the sides of the sink divider and the bladder may extend through this conduit or be coupled with this conduit. The support frame may form a channel along the side and the base to secure the bladder therein, whereby the bladder expands and enlarges away from the channel of the support frame. Also, the pressure receptacle may be formed in the support frame. The one-way valve and the pressure valve may be coupled with the support frame.

An exemplary sink divider system may have cover panels such as a water cover face one face of the sink divider and a dry cover face on the opposing face of the sink divider. These cover faces or panel may be integral to the support frame, wherein they are a monolithic component with the support frame, or they may be attached by an adhesive or fastener, for example. The water cover face may be configured to face a compartment of a sink that receives water to form a tub of water in that compartment and the dry cover face may be configured to face a dry compartment of the sink. The dry cover face may have a drain port to allow and fluid that was released by the pressure valve to flow out from the interior of the sink divider out into the sink; the interior being between the water and dry cover faces.

An exemplary sink divider system may have a retainer arm assembly that is configured to deploy, or extend outward toward the first side and second side of the sink divider, a first side retainer arm and a second side retainer arm, respectively. Each of the first side and second side retainer arms may have a retainer foot on the extended end that is configured to prevent the retainer arm and sink divider from moving or dislodging. The foot may be made of a non-slip type material, or high friction material having a high static coefficient of friction with a metal surface of about 0.4 or more, about 0.5 or more, about 0.7 or more, about 0.9 or more and any range between and including the coefficient of friction values provided. The static coefficient of friction may be determined by ASTM D1984-14, Standard Test Method For Static and Kinetic Coefficients of Friction with the sled covered with the foot material and the stationary plane being the metal. The retainer foot may be rubber, or an elastomer material, as defined herein. The static coefficient of friction of rubber on a steel plate is about 0.62 or more, for example.

The retainer feet may be made of a soft rubber material having a durometer of about 70 Shore A or less, about 60 Shore A or less, about 40 Shore A or less, about 20 Shore A or less, or even about 60 Shore OO or less, about 40 Shore OO or less and any range between and including the values provided.

The retainer arms may be configured to be deployed by a deployment apparatus that forces each of the retainer arms outward when activated. A release button may be configured to release a latch from a latch catch on the arm or arms to allow the spring to extend and force the retainer arms outward. Each retainer arm may have a separate deployment apparatus or both retainer arms may be deployed by a single deployment apparatus, wherein a spring is configured between the latch ends of the retainer arms.

The support frame may form channels for the first and second side retainer arms to move outward and these channels may contain the spring or springs of the deployment apparatus. The release button as well as the latch may also be coupled with the support frame.

The retainer arms may have arm threads that are threadedly engaged with a threaded member to allow the retainer arms to be rotated to actuate the retainer arm and retainer arm feet outward from the side of the sink divider to provide more force on the sink wall or rotated in the opposite direction to reduce the force of the retainer feet on the sink wall for moving or removal of the sink divider from the sink. The threadedly engaged retainer arms may also be forced outward to or away from the sides of the sink divider by a spring to prevent the retainer arms from threading into or toward the sink divider to reduce the force of the retainer feet on the sink walls. The first and second retainer arms may be force outward by a single spring that extends through the threaded members, for example, or a separate spring may be coupled with the first side retainer arm and second side retainer arm separately.

An exemplary sink divider system may utilize one or more suction cups configured to attach to the sink, such as to the sink base on the dry-side of the sink to prevent the base of the sink divider from being pushed away from the water-side of the sink, when the sink is divided by said sink divider and water is retained on the water-side of the sink. An exemplary suction cup retainer may be place on the sink base proximal to the base of the sink divider and may have a suction cup lever that is configured to actuate to increase the suction force of the suction cup retainer by pulling on the suction cup.

The sink divider has a base and extends vertically to the top when configured in a sink with the base extending along the sink base and with the first side and second side of the sink divider extending vertically up along the sink walls to divide the sink. The water cover face extends across the sink such as on a side to retain water and the dry cover face extends across the sink on the opposing side from the water cover face.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
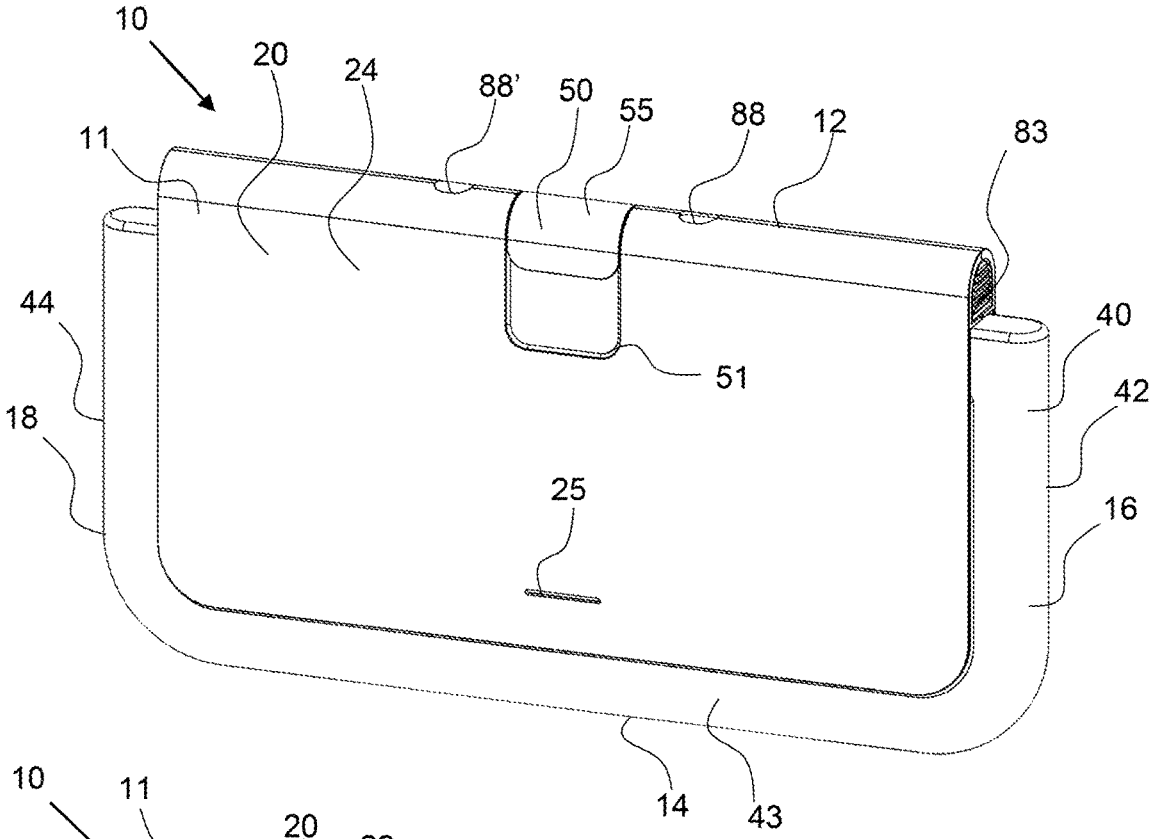
FIG. 1 shows a perspective view of the dry face of an exemplary sink divider having a bladder that extends from the pressurization apparatus along both the first and second side and along the base of the sink divider, wherein the bladder is configured to receive a fluid, such as water, from the pressurization apparatus that comprises a plunger that when pushed down, forces fluid into the bladder from the pressure receptacle.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations, and improvements of the described embodiments, will occur to those skilled in the art and all such alternate embodiments, combinations, modifications, improvements are within the scope of the present invention.

Figure 2:
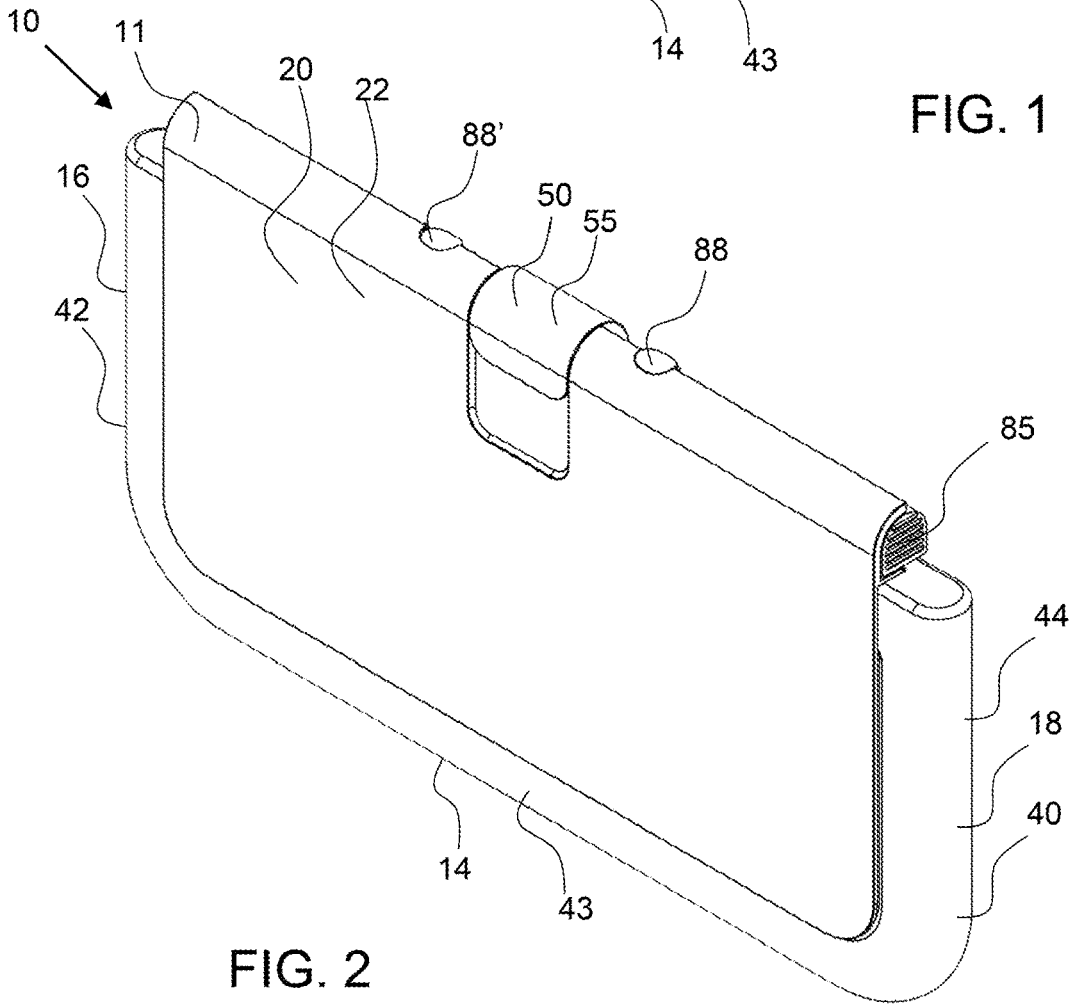
FIG. 2 shows a perspective view of the water face of the exemplary sink divider shown in FIG. 1 and the second side retainer stop that is coupled to the second side retainer arm that is spring deployed when the release button is pressed to release the second side retainer arm.
Figure 4:
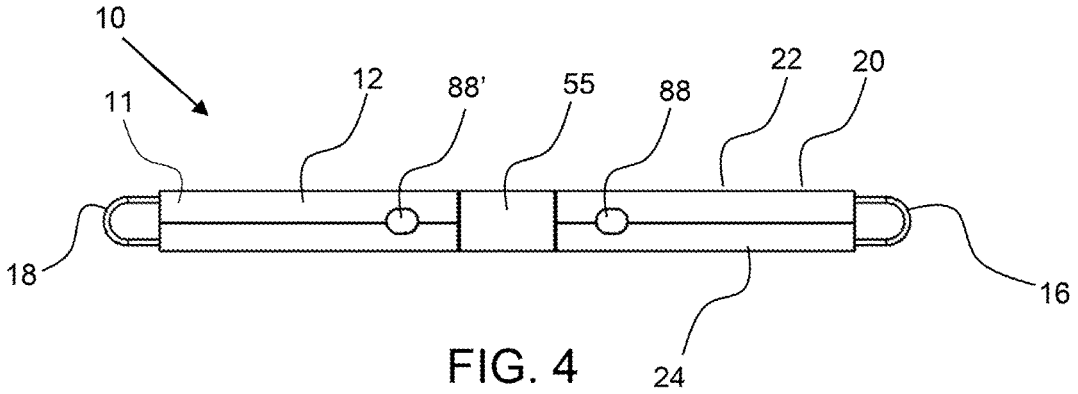
FIG. 4 shows a top view of the exemplary sink divider shown in FIG. 3.
Figures 3, 5, 6:
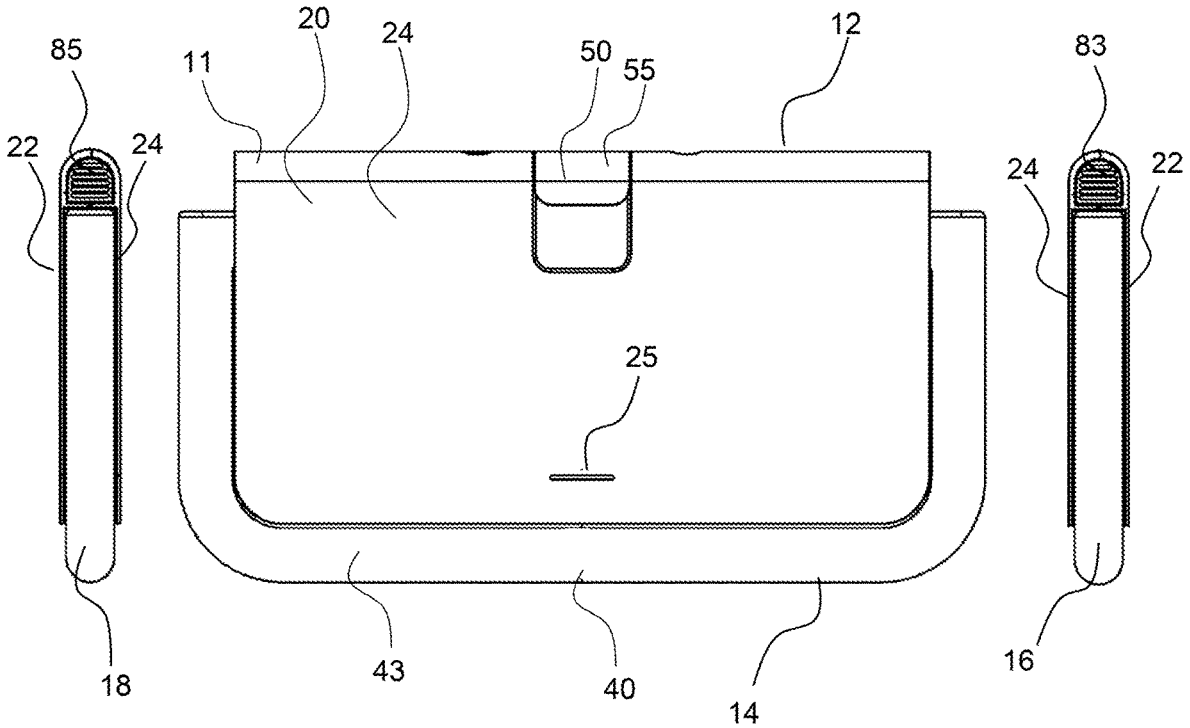
FIG. 3 shows a front, dry face view of the exemplary sink divider shown in FIG. 1.
FIG. 5 shows a first side view of the exemplary sink divider shown in FIG. 3.
FIG. 6 shows a second side view of the exemplary sink divider shown in FIG. 3.

Referring now to FIGS. 1 to 5, an exemplary sink divider system 10 has a bladder 40 that forms a loop from the pressurization apparatus 50 having a first side bladder portion 42 and a second side bladder portion 44 that extend along the first side 16 and second side 18, respectively, of the sink divider 11, and a bladder base portion 43 that extends along the base 14 or bottom of the sink divider, when the sink divider is configured in a sink, oriented vertically up towards the top from said base. The pressurization apparatus 50 has a plunger 55, configured along the top 12 of the sink divider 11 to force fluid, such as water, into the bladder when pushed down into the fluid receptacle 51. A cover panel 20 has a water cover face 22 and a dry cover face 24 on opposing faces of the sink divider 11. A cover panel may be two separate panels or pieces or may extend continuously from one surface over the top of the sink divider to the opposing surface. These cover faces extend over the support frame and may be an integral part of the support frame, wherein the frame and cover face are a monolithic component, or may be attached to the frame by adhesive or fasteners, for example. A drain port 25 is configured on the dry cover face 24 to allow fluid expelled from the pressure relief valve (not shown) to flow out from the interior of the sink divider. As best shown in FIG. 2, the exemplary sink divider system 10 has release buttons 88, 88' to release each of the first side retainer arm and second side retainer arm, respectively. The first side retainer arm has a first side retainer foot 83 and the second side retainer arm has a second side retainer foot 85 that are configured to press against the inside wall of a sink to secure the sink divider in place.

Figure 7:
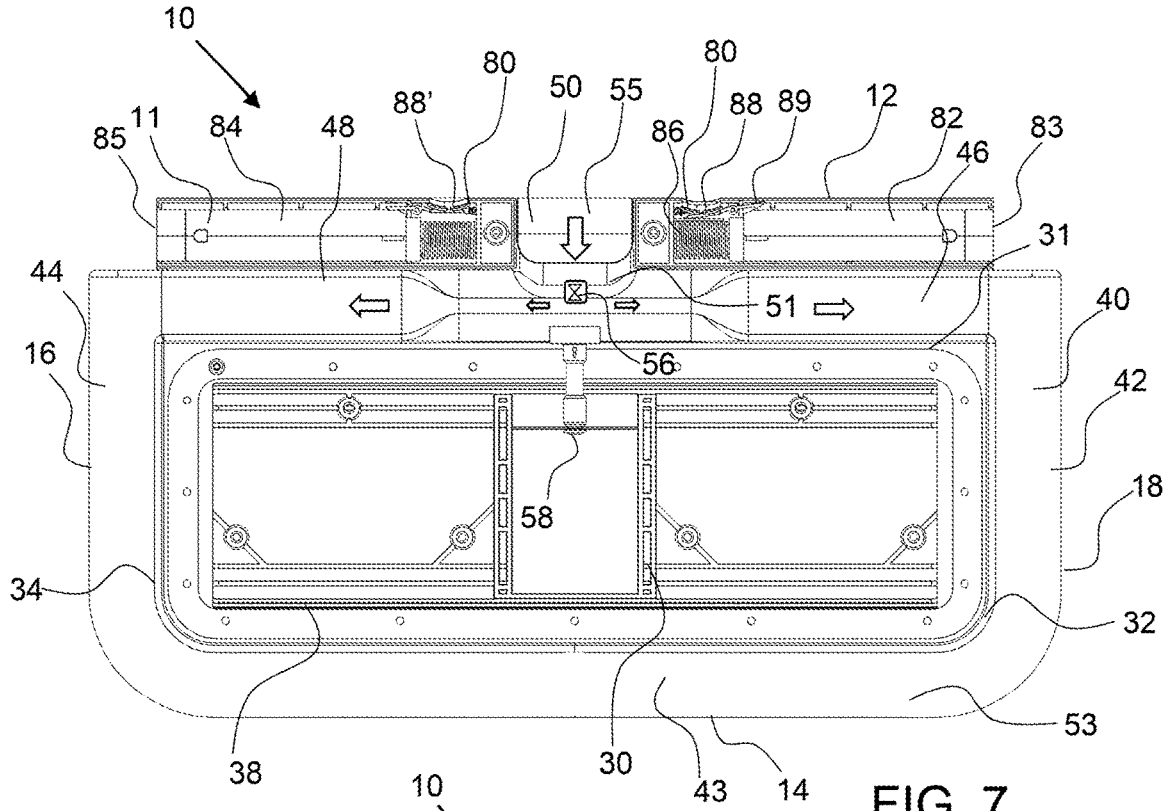
FIG. 7 shows a front, dry face view of the exemplary sink divider shown in FIG. 1, with the dry cover face removed to show the support frame with the bladder extending down along the first and second side of the support frame and along the bottom or base of the support frame. Note that the bladder may extend along a curve from the horizontal extension from the pressurization apparatus down along the sides of the sink divider to prevent any kinking of the bladder.
Figure 8:
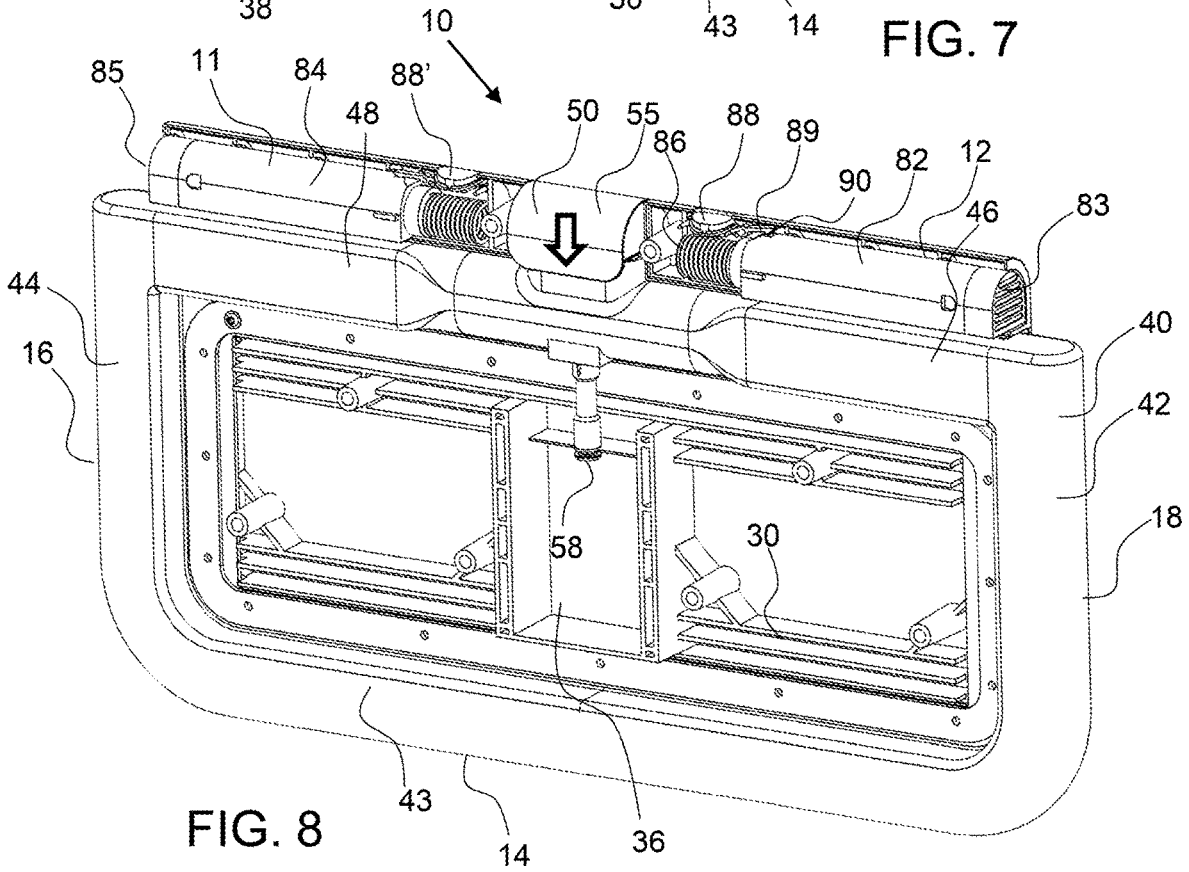
FIG. 8 shows a perspective view of the exemplary sink divider shown in FIG. 7, and the retainer arm assembly having a first side retainer arm and a second side retainer arm, each having deployment apparatus containing a spring, that forces the retainer arms outward, toward their respective sides to retain the sink divider against the walls of the sink.
Figure 9:
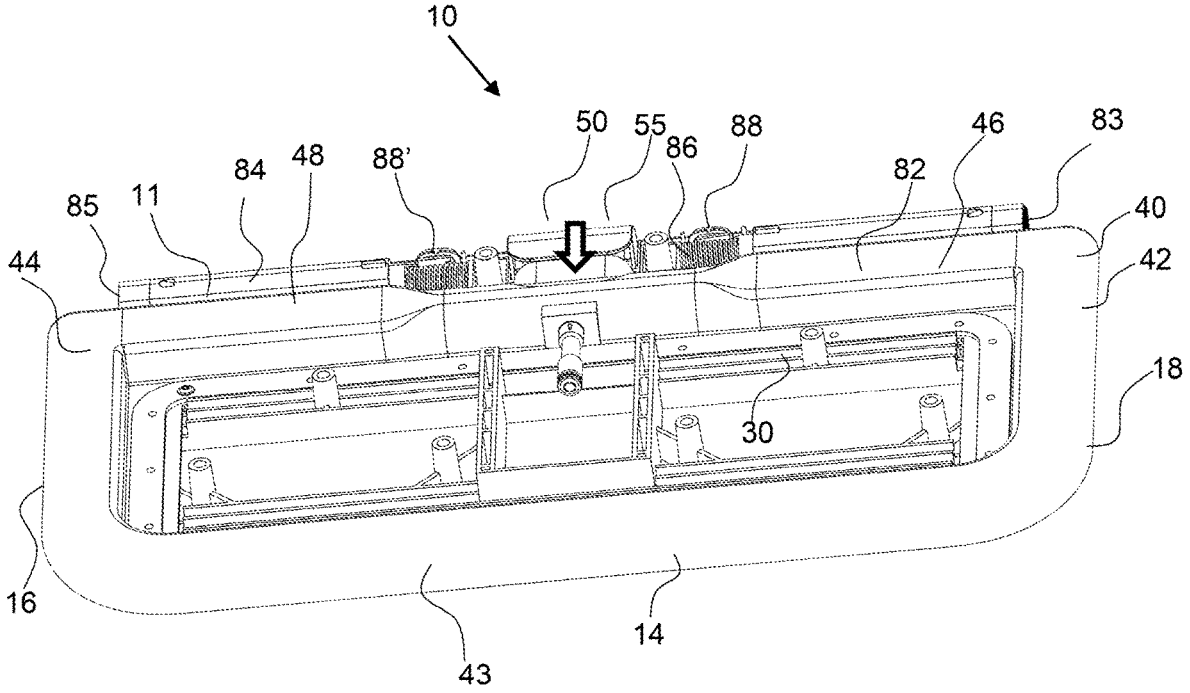
FIG. 9 shows a base perspective view of the exemplary sink divider shown in FIG. 7.

Referring now to FIGS. 7 to 9, the sink divider has a support frame 30 with a top 31 and a first bladder extension 46 and second bladder extension 48 extending from the pressurization apparatus 50 to respective first side 32 and second side 34 of the support frame. A first side bladder portion 42 and second side bladder portion 44 extend down along the first side 32 and second side 34 of the support frame 30, respectively. The bladder extends down along the first side 32 of the support frame and then turns along a radius of curvature to extend along the base 38 of the support frame before turning along a radius of curvature to extend along the second side 34 of the support frame to complete the bladder loop from the pressurization apparatus. The bladder may extend to the pressurization apparatus 50 or may be coupled with a conduit that is coupled with the pressurization apparatus. The bladder is are configured to expand with a fluid that is pressurized therein by the pressurization apparatus 50.

The pressurization apparatus 50 has a plunger 55 on the top of the sink divider 11 to force fluid 5384, such as water, into the bladders when pushed down into the fluid receptacle 51. A one-way flow valve permits fluid from the fluid receptacle to flow into the bladders but not back out of the bladders into the fluid receptacle. A pressure relief valve 58 is in fluid communication with the one-way flow valve and the bladder to ensure that the bladders are not pressurized above a threshold limit. Fluid is configured to be expelled from the pressure relief valve 58 into the interior 36 of the sink divider 11. This fluid from the pressure relief valve is configured to drain out of the drain port 25 shown in FIG. 1.

The sink divider has a first side retainer arm 82 with a first side retainer foot 83 configured on the extended end of the first side retainer arm, and a second side retainer arm 84 with a second side retainer foot 85 configured on the extended end of the second side retainer arm. The retainer arms are each coupled with a retainer arm deployment apparatus 80 that has a spring 86 configured to force the retainer arm out toward the side of the sink divider 11. The retainer arms are retained by a latch 89 coupled with a latch retainer 90 on the retainer arm, such as a recess or hole. The release button 88 is configured to actuate the latch 89 to release the latch from the latch retainer 90 and allow the spring 86 to force the retainer arm outward. As shown, the first side retainer arm 82 has a first retainer arm deployment apparatus 80 with a release button 88, and the second side retainer arm 84 has a separate second retainer arm deployment apparatus 80' with a separate release button 88'. It is envisioned that a single retainer arm deployment apparatus may be used to deploy both of the first side and second side retainer arms simultaneously.

Figure 10:
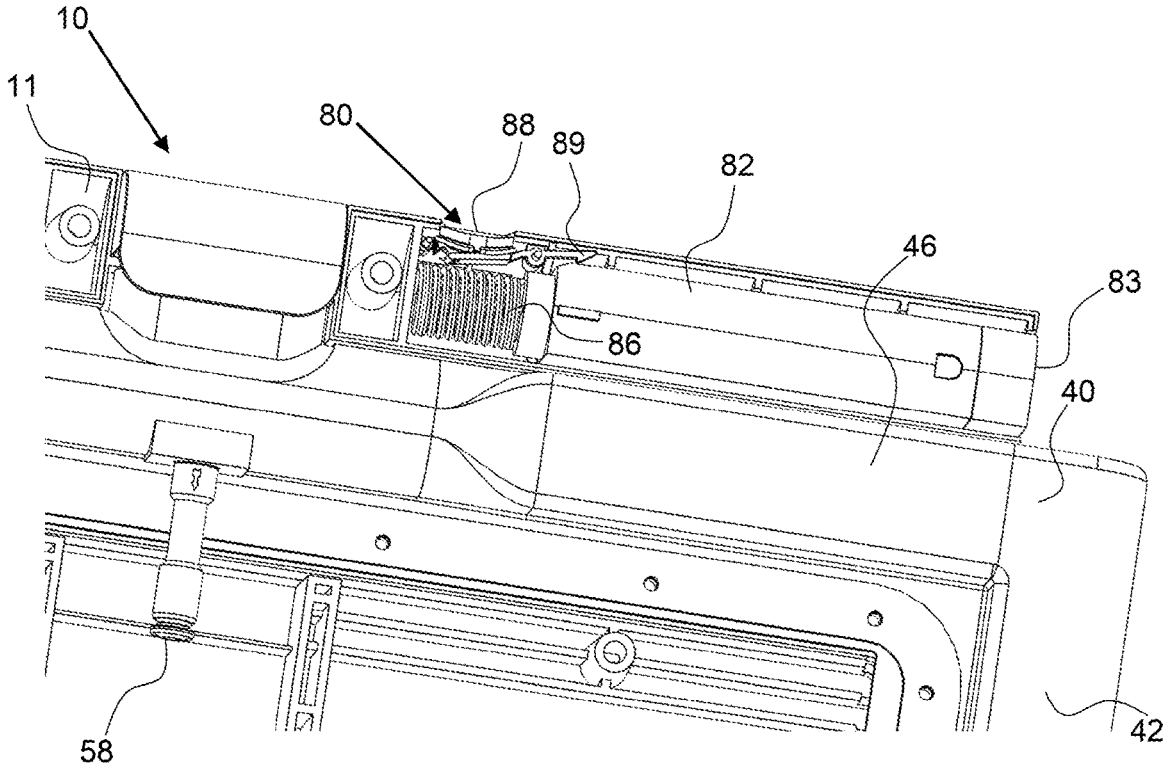
FIG. 10 shows a perspective view of the exemplary sink divider shown in FIG. 7 and the first side retainer arm deployment apparatus that includes a spring, a release button, a latch and a latch catch.
Figure 11:
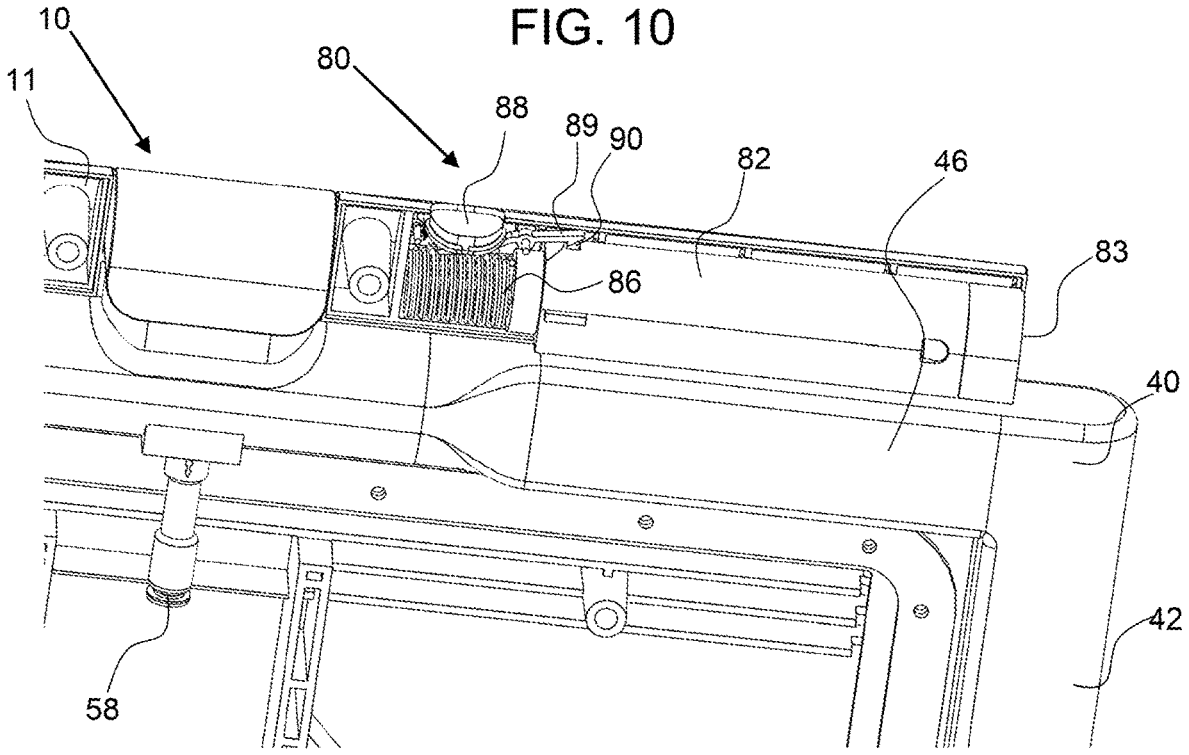
FIG. 11 shows a perspective view of the exemplary sink divider shown in FIG. 7 and the first side retainer arm deployment apparatus that includes a spring, a release button, a latch and a latch catch.
Figure 12:
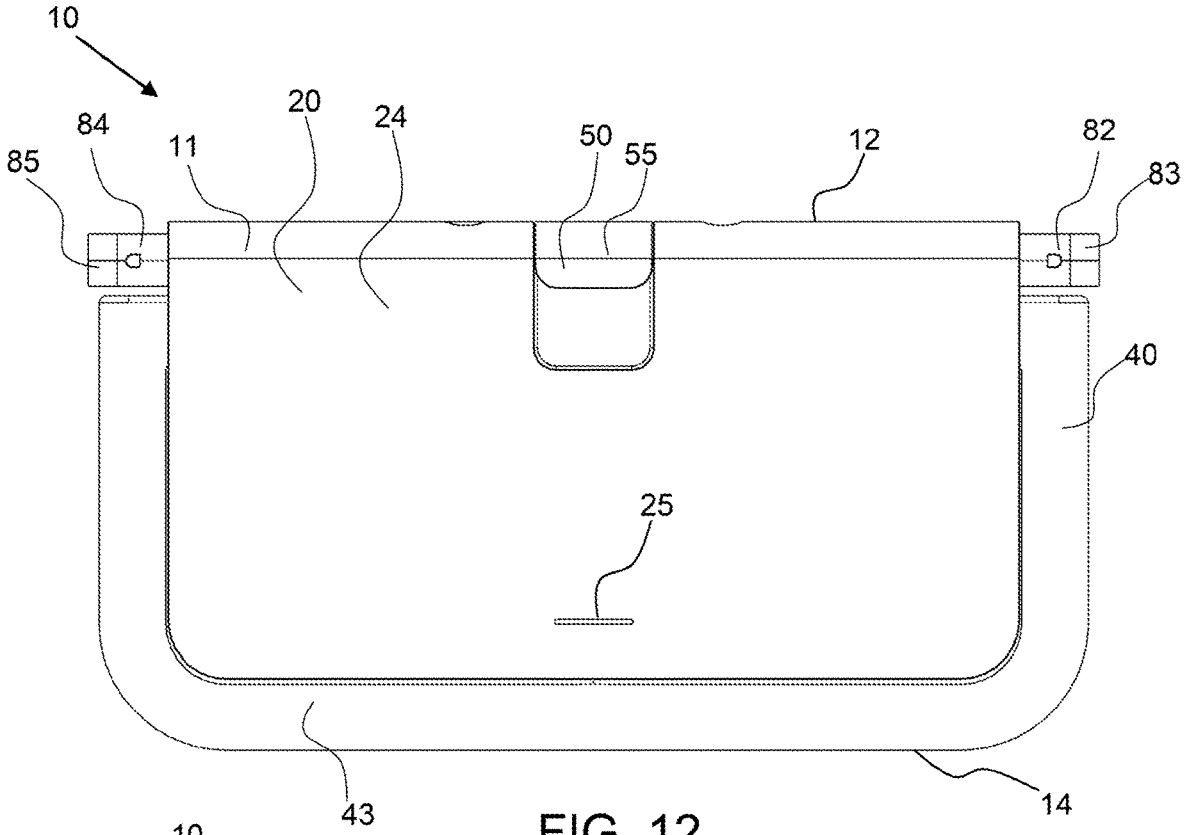
FIG. 12 shows a front view of the exemplary sink divider shown in FIG. 3 with the first side and second side retainer arms deployed out.

The first retainer arm deployment apparatus 80 is better shown in FIGS. 10 and 11. The release button 88 is configured to actuate the latch 89 to release the latch from the latch retainer 90 and allow the spring 86 to force the first side retainer arm 82 outward.

Figure 13:
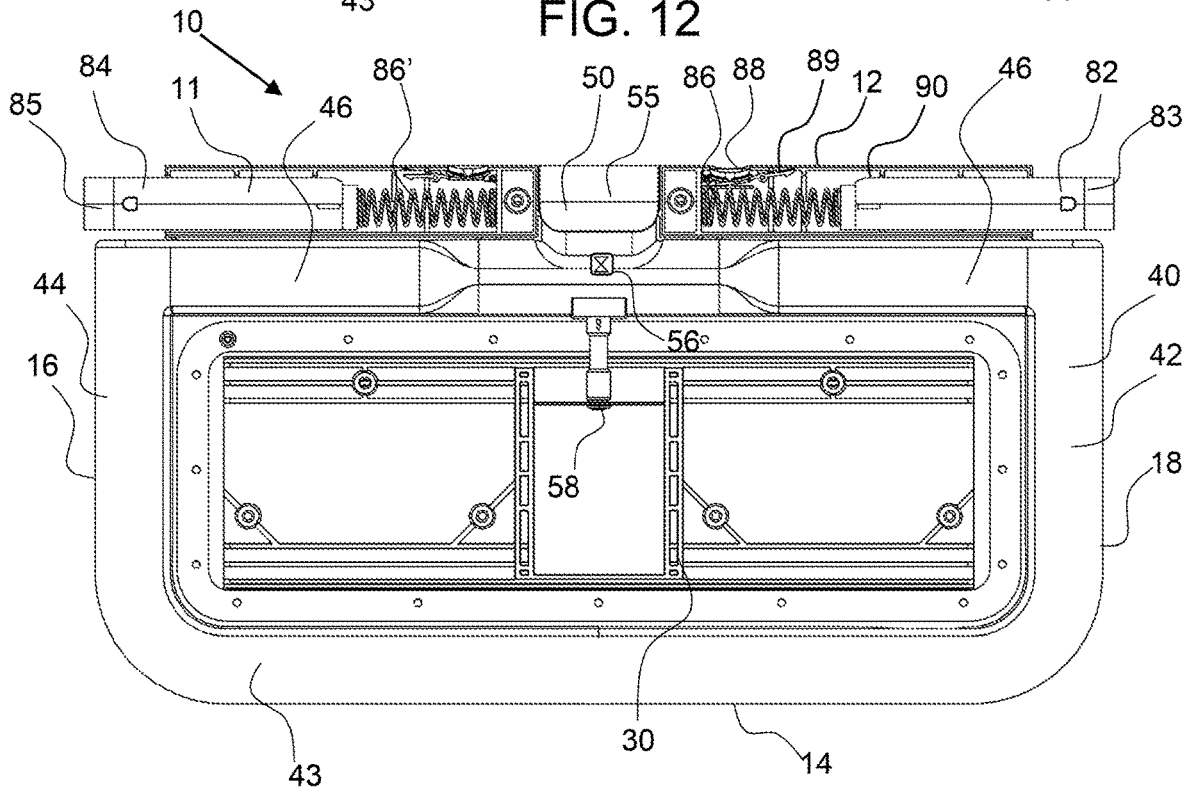
FIG. 13 shows a front view of the exemplary sink divider shown in FIG. 7 with the first side and second side retainer arms deployed out.
Figure 14:
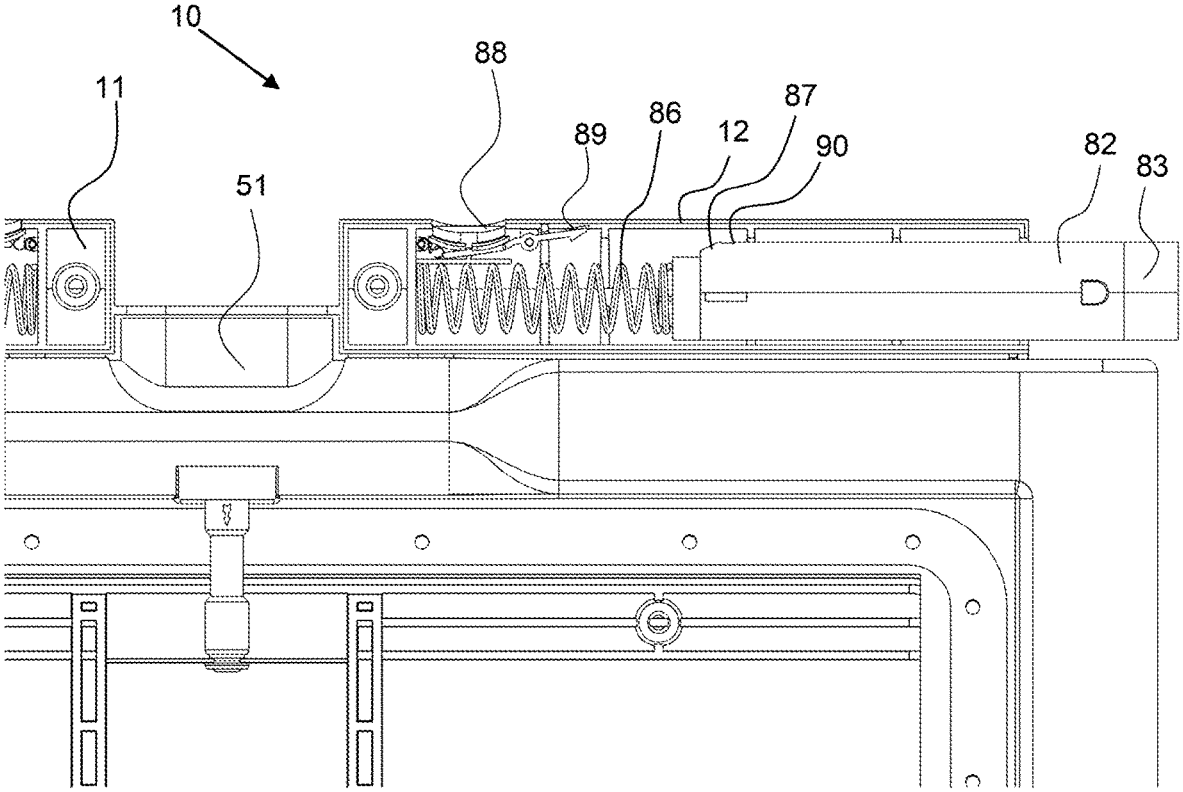
FIG. 14 shows an enlarged front view of a portion of the exemplary sink divider shown in FIG. 13 with the first side and second side retainer arms deployed out.

Referring now to FIGS. 12 to 16, the exemplary sink divider 11 is configured with the first side retainer arm 82 and second side retainer arm 84 deployed or extended out. The first retainer foot 83 and the second side retainer foot 85 may be made out of a high friction material, such as rubber, or urethane to better retain the sink divider against a sink wall. As shown in FIG. 13, the springs 86, 86' are extended to push the first side retainer arm 82 and second side retainer arm 84 out, respectively. As shown in FIG. 14, the latch 89 is actuated up to release the latch from the latch retainer 90, configured on the latch end 87 of the first side retainer arm 82.

Figure 15:
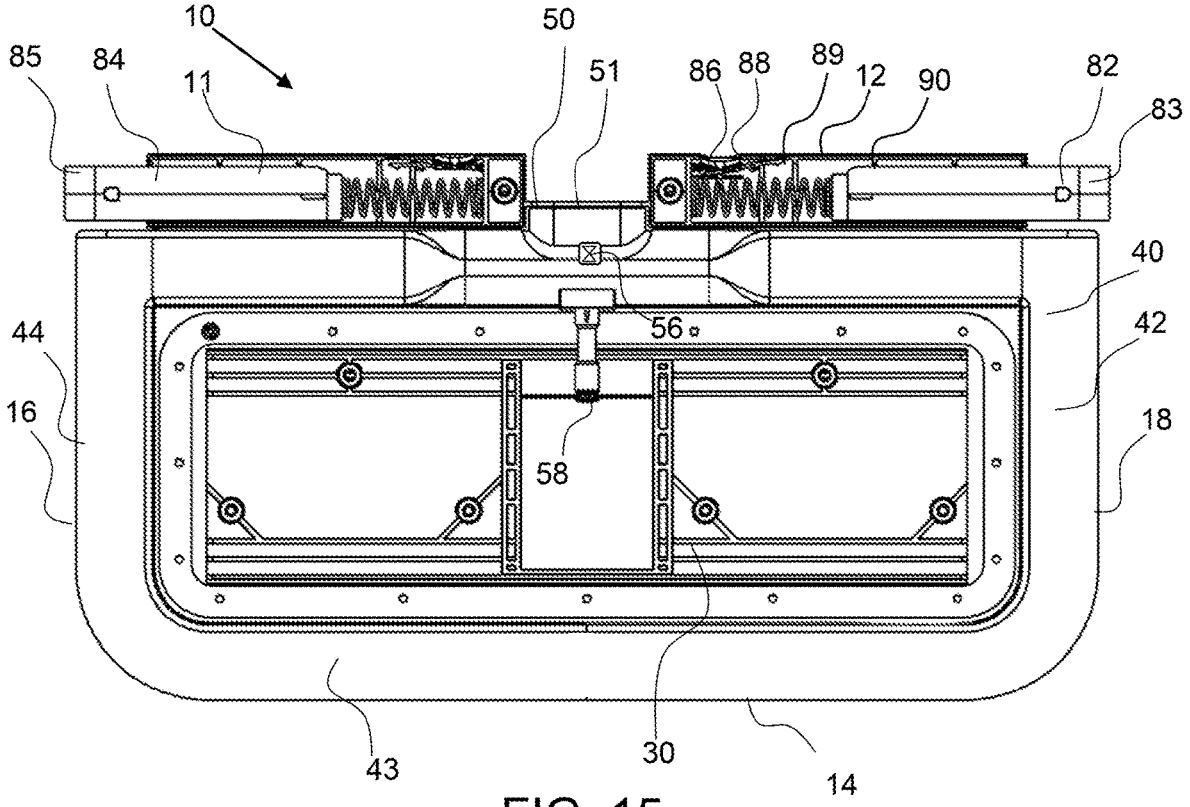
FIG. 15 shows a front view of the exemplary sink divider shown in FIG. 7 with the first side and second side retainer arms deployed out and with the plunger removed.
Figure 16:
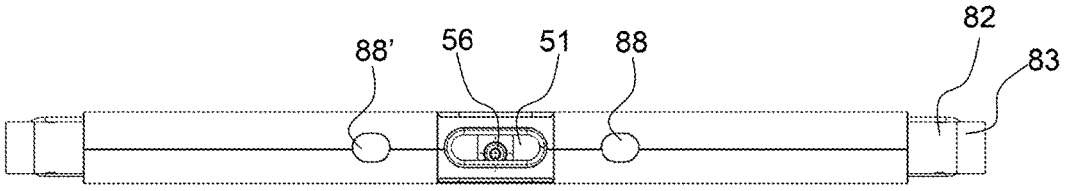
FIG. 16 shows a top view of the exemplary sink divider shown in FIG. 15 with the first side and second side retainer arms extended out and with the plunger removed.

Referring to FIGS. 15 and 16, the plunger is removed to expose the fluid receptacle 51 of the pressurization apparatus 50. As shown in FIG. 16, the one-way valve 56 is configured in the bottom or base of the fluid receptacle 51. As described herein, a fluid, such as water, may be poured into the fluid receptacle and then the plunger may be pushed down to force the fluid through the one-way valve 56 and into the bladder 40.

Figure 17:
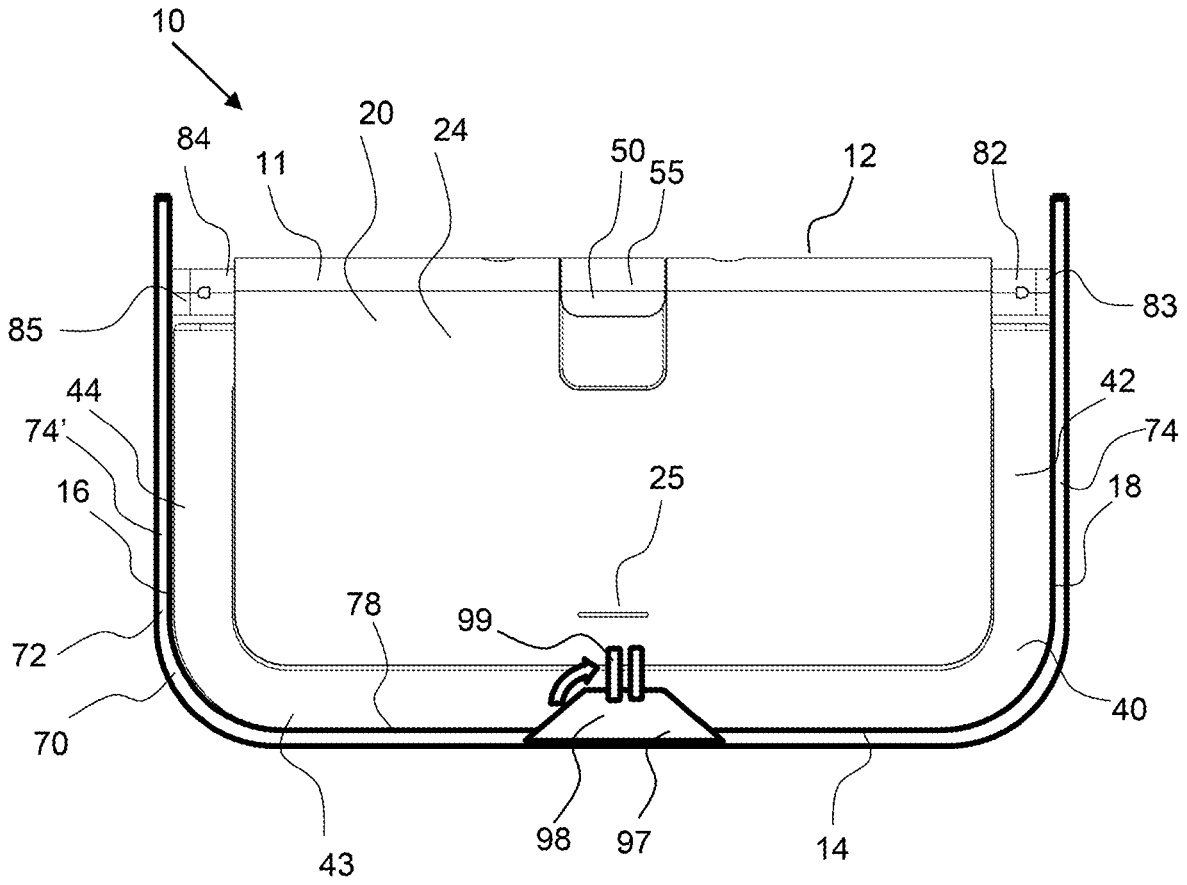
FIG. 17 shows a front view of the exemplary sink divider shown in FIG. 7 configured in a sink with the first side retainer arm and the second side retainer arm extended out.
Figure 18:
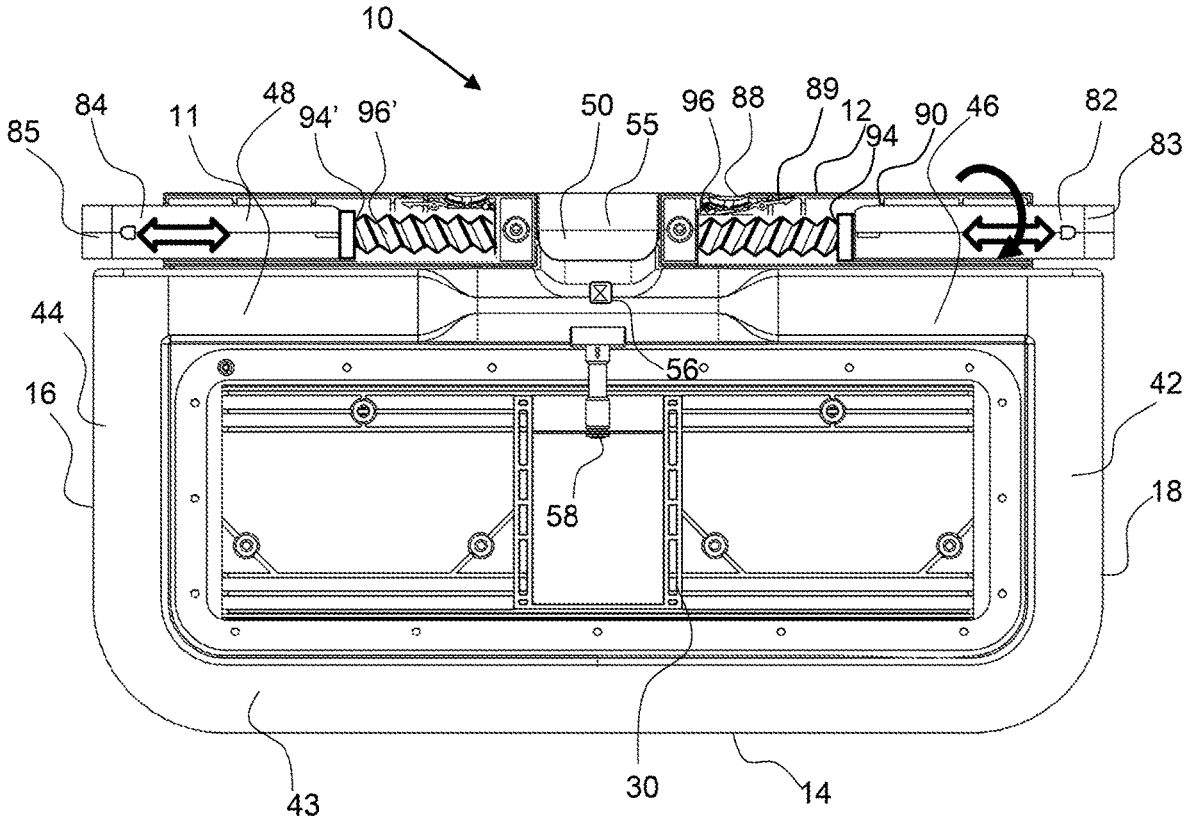
FIG. 18 shows a front view of the exemplary sink divider with the first side and second side retainer arms threadedly engaged with threaded members to move the retainer arms outward for effective retention of the sink divider along the sink wall.

FIG. 17 shows the exemplary sink divider 11 shown in FIG. 7 configured in a sink 70 with the first side retainer arm 82 and the second side retainer arm 84 extended out against the sink wall 72, particularly the side extensions 74, 74' of the sink wall, respectively. The first-side bladder portion 42 and second-side bladder portion 44 extend down along the side extensions 74, 74' respectively and then turn to bladder base portion 43, that extends along the sink base 78 of the sink 70. The first-side bladder portion 42 and second-side bladder portion 44 each turn orthogonally from the side extension to the bladder base portion 43. The first-side bladder portion 42 and second-side bladder portion 44 extend a radius of curvature from the side of the sink divider 11 to the base 14 that is effectively the same as the curvature of the sink wall between the sink base 78 and the side extensions 74, 74'. The first-side bladder portion 42 and second-side bladder portion 44 expand to press against the sink wall and the bladder base portion 43 presses against the base of the sink 70. The retainer arms engaged with the side extensions of the sink 70 may resist the bladder base portion 43 from lifting the sink divider 11 up, and this countering force may enable a tight seal along the sink base 78. The exemplary sink divider system 10 includes a sink divider 11 and a suction cup retainer 98 comprising a suction cup 97 that is configured for coupling to the sink base to secure the sink divider in place. A suction cup retainer as shown in FIG. 17 may be included with any of the embodiments of sink divider as described herein.

As shown in FIG. 17, an exemplary sink divider system 10 includes a sink divider 11 having a first side retainer arm 82 and second side retainer arm 84 that are threadedly engaged with respective threaded members 96, 96', whereby the first and second side retainer arms are configured to be rotated about the threaded members to move the threaded arm in and/or out to provide effective force on the sink wall for retention. Rotating the first and second threaded arms a first direction will move the retainer arms in towards the sink divider 11 to reduce the force of the first side and second side retainer feet on the sink wall and rotating the first and second threaded arms the opposite direction will move the retainer arms away or out from the sink divider to provide more force on the sink wall. The first side and second side retainer arms have respective arm threads 94, 94' that engage with the threaded members. The retainer arms may have male or female threads and the threaded member may be the opposite thread type, male or female threads. The retainer arms may be rotated about the threaded members to reduce the force of the arms on the sink wall for removal of the sink divider from the sink.

Figure 19:
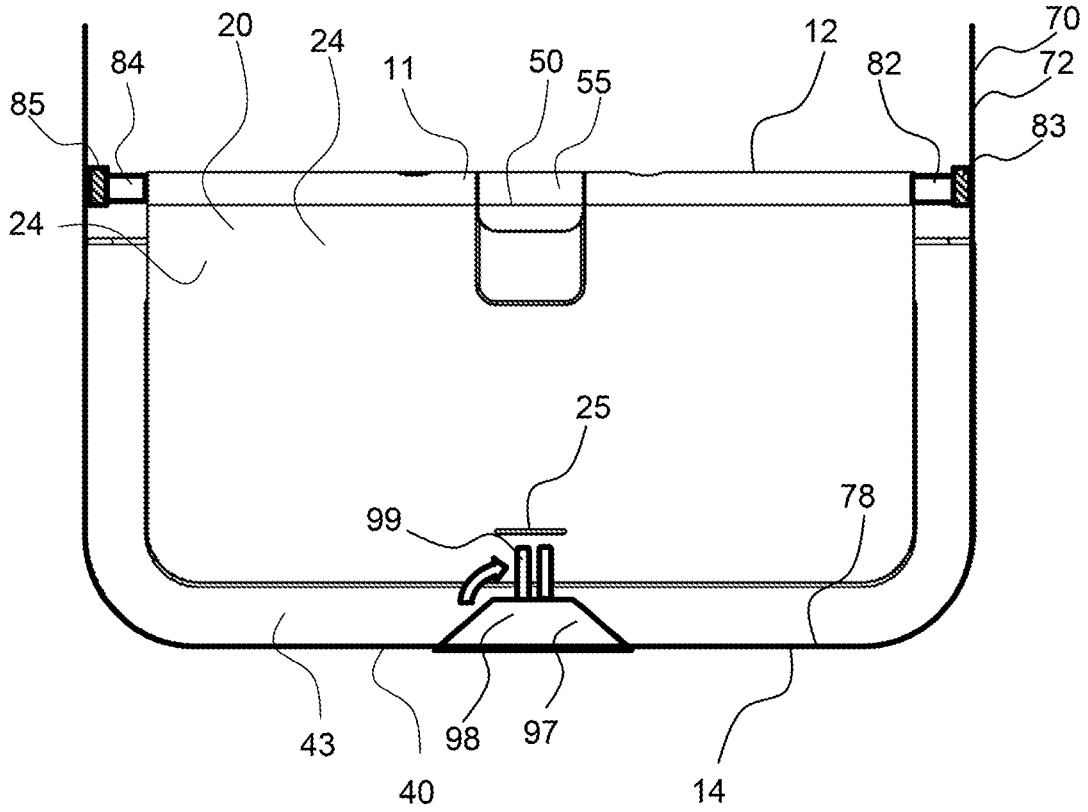
FIG. 19 shows a front view of the exemplary sink divider with a suction cup retainer configured on the sink base
Figure 20:
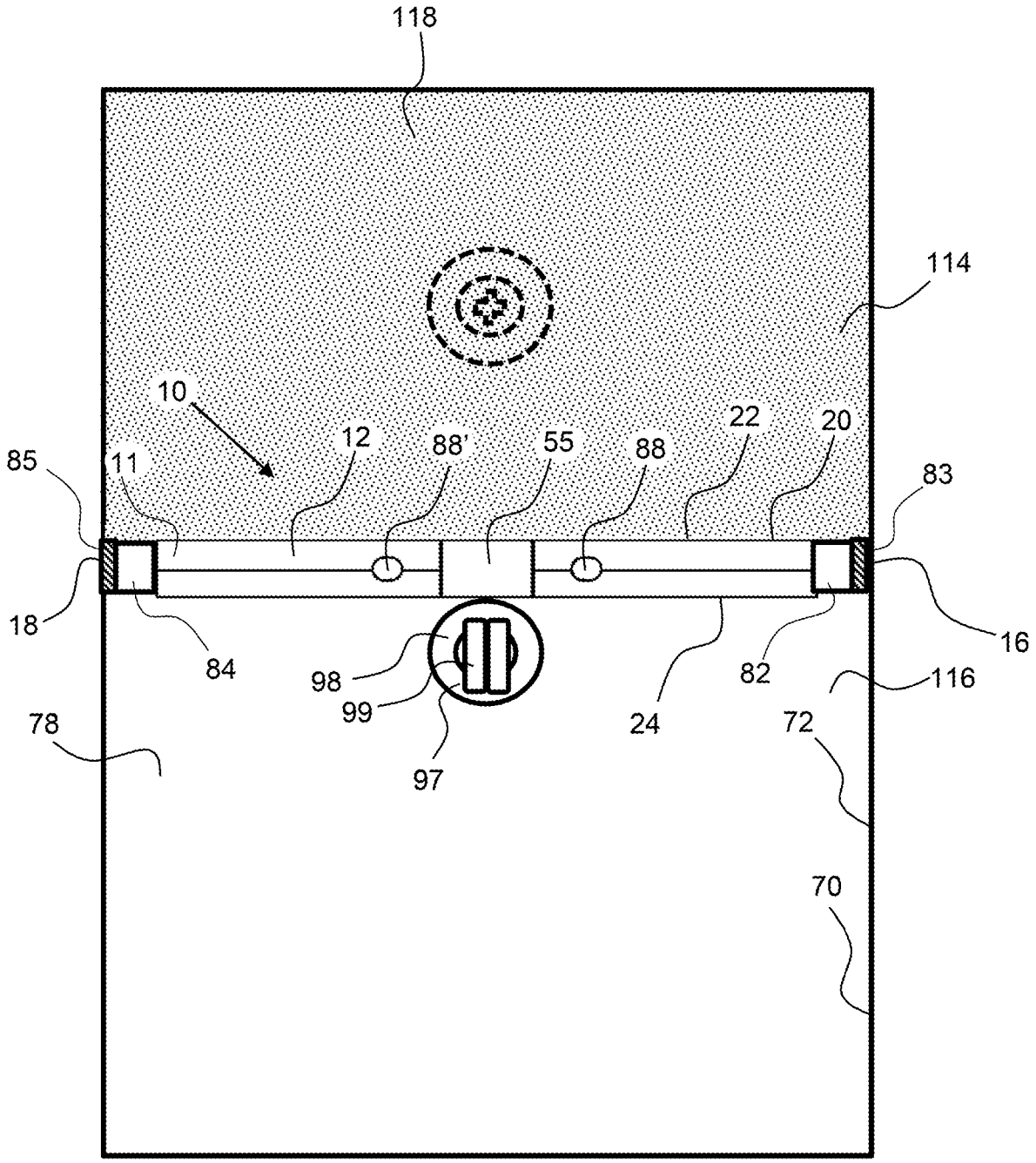
FIG. 20 shows a top view of an exemplary sink divider with the first side and second side retainer arms extended out to press on the sink wall and a suction cup configured on the sink base on the dry side of the sink to prevent the sink divider from being displaced.
Figure 21:
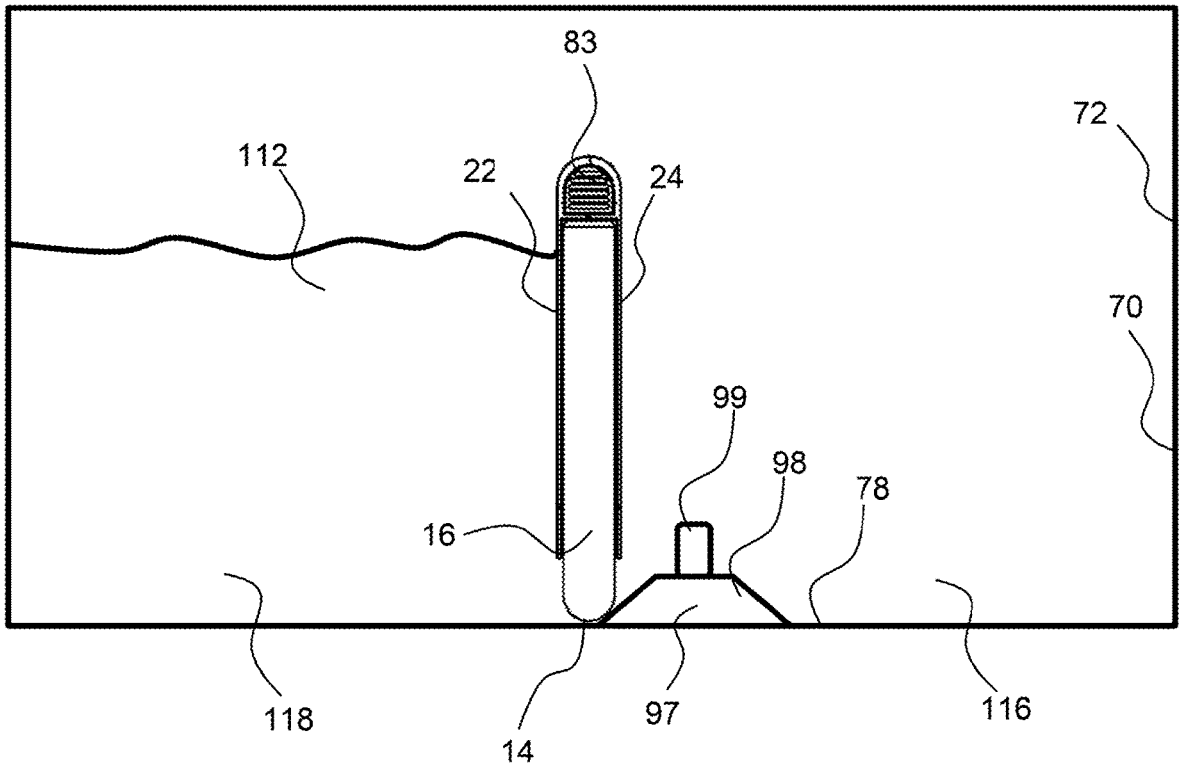
FIG. 21 shows a side view of the first side of an exemplary sink divider configured in a sink with a suction cup configured on the sink base on the dry side of the sink to prevent the sink divider from being displaced.

Referring now to FIGS. 19 to 21, an exemplary sink divider system 10 includes a sink divider 11 and a suction cup retainer 98 has a suction cup 97 that is configured for coupling to the sink base 78 to prevent the base 14 of the sink divider from slipping toward the dry-side 116 of the sink 70. The water-side 118 of the sink 70 has water 112 retained by the sink divider 11. The suction cup retainer 98 may have a suction cup lever 99 that is actuated such as by rotation or pivoting to increase the suction force of the suction cup retainer 98 to the sink base 78. The first side retainer foot 83 and second side retainer foot 85 press against the sink wall 72 to retain the sink divider 11 and particularly the top 12 of the sink divider in position along the sink wall 72.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A sink divider system comprising:

a) a support frame having
   a first side;
   a second side; and
   a base;

b) a cover panel having a water face and a dry face;

c) a bladder extending along said first side of the support frame, along said base of the support frame and along said second side of the support frame;

d) a pressurization apparatus comprising:

i) pressure receptacle for receiving a fluid;

ii) a plunger configured to seal the pressure receptacle;

wherein the first side bladder portion and second side bladder portion are configured to press against a sink wall of a sink to retain the sink divider system within said sink.

2. The sink divider system of claim 1, wherein the plunger extends into said pressure receptacle and is configured to force said fluid from the pressure receptacle into the bladder to pressurize and expand the first side bladder portion and second side bladder.

3. The sink divider system of claim 1, wherein the pressurization apparatus comprises a one-way flow valve that allows water to flow from the pressure receptacle into the bladder.

4. The sink divider system of claim 1, wherein the pressurization apparatus further comprises a pressure valve coupled with the bladder that is configured to release said fluid when a pressure in said bladder exceeds a threshold pressure level.

5. The sink divider system of claim 4, wherein the dry face of the cover panel comprises a flow port that allows fluid released from the pressure valve to flow out from an interior of the support frame through said flow port.

6. The sink divider system of claim 4, wherein the bladder is elastic.

7. The sink divider system of claim 6, wherein the bladder is made of an elastomeric material.

8. The sink divider system of claim 1, further comprising:

a retainer arm assembly comprising:

i) a first side retainer arm and a second side retainer arm that are configured to actuate out from respective first side and second side of the support frame to retain the sink divider in position along said sink wall.

9. The sink divider system of claim 8, wherein the first side retainer arm and a second side retainer arm each comprise a retainer foot configured on an extended end of said first side retainer arm and a second side retainer arm.

10. The sink divider system of claim 9, wherein the retainer foot of the first side retainer arm and a second side retainer arm is a high friction material having a static coefficient of friction with steel of at least 0.4 according to ASTM D1984-14.

11. The sink divider system of claim 10, wherein the first side retainer arm and the second side retainer arm have arm threads; and wherein the retainer arm assembly further comprises a threaded member and wherein the first side retainer arm and second side retainer arm are threadedly engaged with the threaded member to actuate out from the respective first side and second side of the support frame to contact said sink wall.

12. The sink divider system of claim 11, wherein the plunger extends into said pressure receptacle and is configured to force said fluid from the pressure receptacle into the bladder to pressurize and expand the first side bladder portion and second side bladder.

13. The sink divider system of claim 8, wherein the retainer arm assembly further comprises a deployment apparatus comprising:

a spring configured to force the first side retainer arm and a second side retainer arm outward;

a latch;

a latch catch; and a release button configured to release the latch from the latch catch whereby the spring pushes first side retainer arm and a second side retainer arm outward.

14. The sink divider system of claim 13, wherein the plunger extends into said pressure receptacle and is configured to force said fluid from the pressure receptacle into the bladder to pressurize and expand the first side bladder portion and second side bladder.

15. The sink divider system of claim 13, comprising two deployment apparatuses, a first deployment apparatus coupled with the first side retainer arm and a second deployment apparatus coupled with the second side retainer arm.

16. The sink divider system of claim 13, wherein the pressurization apparatus comprises a one-way flow valve that allows water to flow from the pressure receptacle into the first side bladder portion and the second side bladder.

17. The sink divider system of claim 13, wherein the pressurization apparatus further comprises a pressure valve coupled with the bladder that is configured to release said fluid when a pressure in said first side bladder portion and second side bladder portion exceeds a threshold pressure level.

18. The sink divider system of claim 17, wherein the dry face of the cover panel comprises a flow port that allows fluid released from the pressure valve to flow out from an interior of the support frame through said flow port.

19. The sink divider system of claim 1, wherein the bladder is made of an elastomeric material.

20. The sink divider system of claim 1, further comprising a suction cup retainer configured to detachably attach to said sink wall proximal to the sink divider to prevent movement of the sink divider.

21. The sink divider system of claim 20, wherein the suction cup retainer further comprises a suction cup lever that actuates to increase a suction force of the suction cup retainer.

* * * * *